US005605573A

United States Patent [19]

Salo et al.

[11] Patent Number: 5,605,573

[45] Date of Patent: Feb. 25, 1997

[54] HOLDER FOR A CRADLE OF A COATING BAR OR FOR A COATING BLADE

[75] Inventors: Markku Salo, Muurame; Tauno Orava, Jyväskylä, both of Finland

[73] Assignee: Valmet Corporation, Helsinki, Finland

[21] Appl. No.: 32,963

[22] Filed: Mar. 18, 1993

[30] Foreign Application Priority Data

Mar. 19, 1992 [FI] Finland ..... 921195

[51] Int. Cl.[6] ..... B05C 3/00

[52] U.S. Cl. ..... 118/413; 118/261; 118/126; 15/256.5

[58] Field of Search ..... 118/419, 261, 118/262, 126, 410, 413; 162/281; 15/256.5, 256.51; 427/428; 101/169, 425

[56] References Cited

U.S. PATENT DOCUMENTS

| | | | |
|---|---|---|---|
| 3,596,305 | 8/1971 | Boyland | 15/256.51 |
| 3,659,553 | 5/1972 | Tobias | 118/413 |
| 3,778,861 | 12/1973 | Goodnow | 15/256.51 |
| 3,817,208 | 6/1974 | Barnscheidt et al. | 118/119 |
| 3,855,927 | 12/1974 | Simeth | 118/261 |

FOREIGN PATENT DOCUMENTS 46232 11/1968 Finland .

556947 12/1974 Switzerland .

*Primary Examiner*—Brenda A. Lamb

*Attorney, Agent, or Firm*—Steinberg, Raskin & Davidson, P.C.

[57] ABSTRACT

The invention relates to a holder for a cradle of a coating bar or for a coating blade in a coating unit and a method for securing the cradle of the coating bar or the coating blade in a coating device. The coating bar or blade are arranged to spread and smooth a size film or a corresponding layer of coating agent onto a face of a moving base to be coated by loading the coating bar or blade against the moving base. The moving base may be a roll of a size press or the web passed over a back-up roll. The cradle of the coating bar or the coating blade is mounted in a holder arranged in an application beam transverse to the machine direction. A journalling duct transverse to the machine direction is formed in the frame of the holder. An oblong member is arranged rotatably in the journalling duct and comprises a cam-like projection of eccentric section. The member can be rotated for the purpose of fixing the cradle of the coating bar or the coating blade in its place. In this position, the cam-like projection rests against a rear face of the cradle of the coating bar or of the coating blade and secures the cradle or coating blade against a support provided on the application beam.

12 Claims, 3 Drawing Sheets

HOLDER FOR A CRADLE OF A COATING BAR OR FOR A COATING BLADE

BACKGROUND OF THE INVENTION

The invention relates to a holder for a cradle of a coating bar or for a coating blade in a coating unit. The coating bar or blade is arranged to spread and smooth a size film, or a corresponding layer of coating agent, onto a face of a moving base to be coated by loading the coating bar or coating blade against the moving base. The moving base may be a roll of a size press or a web being passed over a back-up roll. The cradle of the coating bar or coating blade is mounted in the holder which is arranged in an application beam transverse to the machine direction. An arrangement of a coating device which includes the holder of the present invention is also disclosed.

The invention also relates to a method for securing a cradle of a coating bar or a coating blade to holder and keeping the coating bar or blade in a fixed position during the operation of the coating unit.

In surface-coating techniques of paper and board, in particular in surface-sizing techniques, a technique is commonly employed in which a film of a coating agent is spread onto the faces of rolls that form a nip by means of coating devices. The films of coating agent adhere to the faces of the paper or board to be coated as the paper or board runs through the nip formed by a pair of rolls. In a typical coating device, the coating agent is generally introduced under pressure into the application zone, which is defined by the roll face, a coating member, such as a coating blade, bar, or equivalent loaded against the roll face, a dam blade, and lateral seals.

On the other hand, for example in pigmenting of paper, a technique is used in which the pigment coating is applied by coating devices directly onto the face of the web. In such a case, the web is passed over a back-up roll, and the coating member, such as a coating bar or coating blade, is loaded against the web running over the back-up roll so that the coating member applies the desired layer of coating agent directly onto the web face. The coating agent is introduced onto the web in some suitable way before the web runs past the coating member.

In prior art devices, the cradle of the coating bar or coating blade was mounted by means of a holder that was displaceable pneumatically, i.e. by means of a loading hose loaded by means of compressed air. Such a mounting arrangement involved certain drawbacks, of which, for example, failures of hoses should be mentioned. If the loading hose of the holder is broken, it must, of course, be replaced, for which reason it has often been necessary to stop the machine completely.

Variations in temperature have also created problems in prior art devices. In size presses and also in other coating devices, the problems related to variations in temperature are manifested with emphasis in connection with the replacement of rolls. When new rolls or rolls with new coatings are mounted, they are cold. During the operation of the machine, the temperature of the rolls, and also of the other constructions in the machine, is changed so that the cradle is subjected to an extensive thermal expansion. In the case of a bar coating technique, the temperature of the cradle of the coating bar especially changes.

The prior art mode of correcting the problem of undesirable thermal variations, however, prevents thermal expansion of the cradle. This results in considerable problems in the profile of the coating-agent film.

The problems of the prior art devices further include the use of complicated fixtures having numerous locks and guides, as well as the fact that the prior art cradle holders are readily jammed especially when running with pastes.

OBJECTS AND SUMMARY OF THE INVENTION

An object of the present invention is to provide a solution by whose means the drawbacks related to the prior art devices are avoided and by whose means a considerable improvement is obtained over the prior art.

It is another object of the present invention to provide a new and improved cradle holder which is fully mechanical with respect to its operation and thus highly reliable in operation. When the device in accordance with the invention is used, no standstills similar to those experienced in prior art devices are to be expected.

It is yet another object of the present invention to provide a new and improved cradle holder in which the costs of the construction are substantially lower than those of prior art devices.

It is another object of the present invention to provide a new and improved method for securing a cradle of a coating bar of a coating blade in a holder to keep the coating bar or blade in a fixed position during the operation of the coating unit.

It is still another object of the present invention to provide a new and improved method and device which permits the desired fastening tightness of the coating-bar cradle or the coating blade to be realized, even so that the degree of tightening is adjustable. In such a case, possible thermal expansions do not cause any problems in the construction of the cradle holder.

In view of achieving these objects, and others, the present invention comprises a journalling duct is formed transverse to the machine direction in the frame of the cradle holder. An oblong member is arranged to rotate in the journalling duct. The oblong member comprises a cam-like projection of eccentric, or irregular, section and can be rotated for the purpose of fixing the cradle of the coating bar or the coating blade in its place. The rotation of the member causes the cam-like projection to rest against a rear face of the cradle of the coating bar or the coating blade and secures the cradle or coating blade against a support provided on an application beam.

Owing to the circulation of water provided in the holder of the present invention, seizing or jamming does not cause a problem similar to those occurring in prior art devices.

In the method in accordance with the invention for securing the cradle of the coating bar or the coating blade in a coating unit, a support is arranged on an application beam of the coating unit transverse to the machine direction. The cradle of the coating bar or the coating blade is mounted on the application beam. A journalling duct is arranged in a holder on the application beam transverse to the machine direction. The cradle or coating blade is secured against the support by rotating an oblong member in the journalling duct to fix the cradle of the coating bar or the coating blade in an operating position. In this manner, a cam-like projection of the oblong member will rest against a rear face of the cradle of the coating bar or of the coating blade.

Other advantages and characteristic features of the invention come out from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
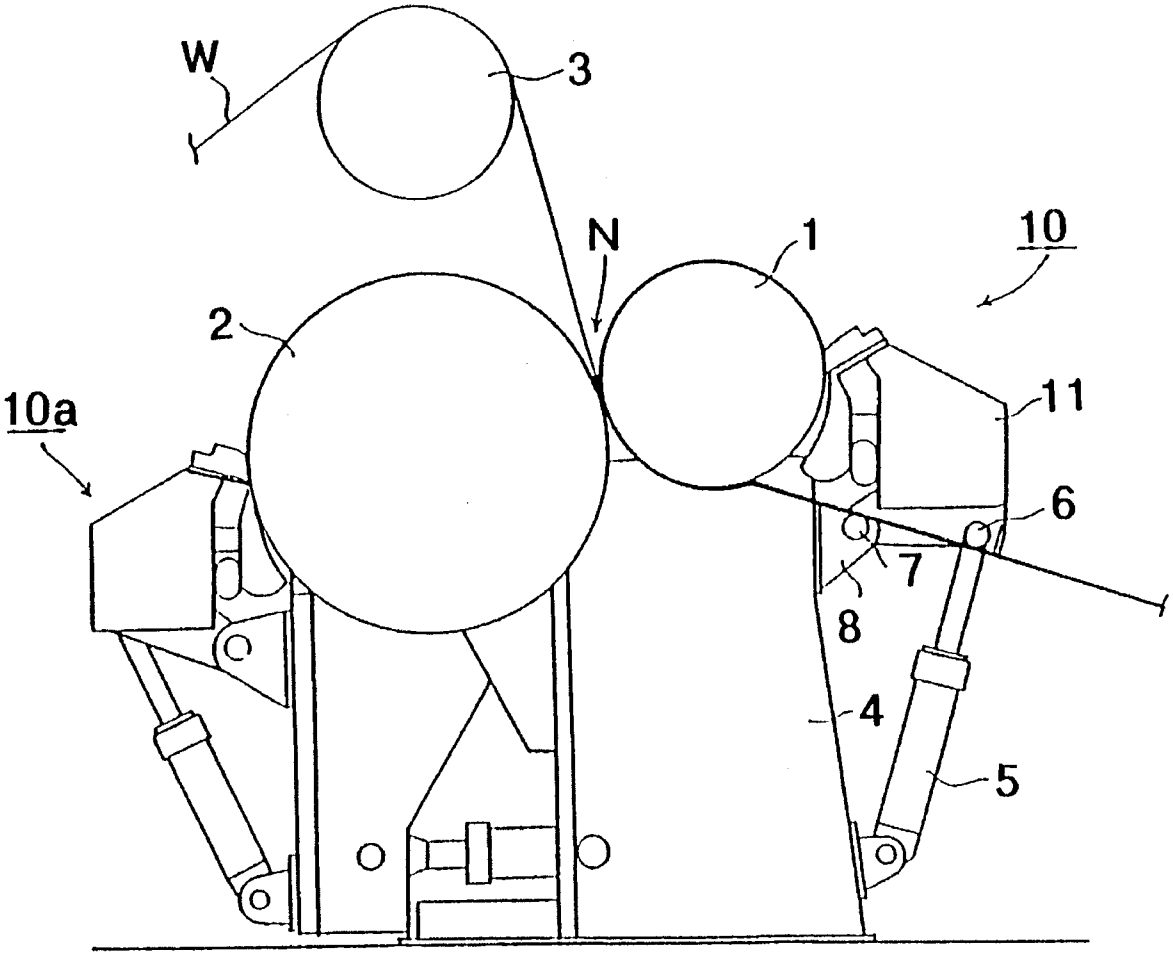
FIG. 1 is a fully schematic side view of a size press or of a corresponding coating device in which the device in accordance with the invention is used.

FIG. 1 is a schematic illustration of a size press or a corresponding coating device, which comprises press rolls 1 and 2. The first roll 1 and second roll 2 form a nip N with one another through which a paper or board web W is passed. In the arrangement shown in FIG. 1, the web W is guided into the nip N over a guide roll 3. In the size press, a first size film is metered onto a face of the first roll 1, i.e. a moving base, by means of a coating unit 10. In a corresponding way, a second size film is metered onto a face of the second roll 2 by means of a coating unit 10*a*. The size films are transferred in the roll nip N from the faces of the rolls 1 and 2 onto the paper or board web W that runs through the nip.

An application beam 11 in the coating unit 10 is mounted on a frame 4 of the size press to pivot by means of an articulation shaft 7 arranged transverse to the machine direction. For this purpose, a bracket 8 is arranged on the frame 4 of the size press for mounting the application beam 11. The application beam 11 is further supported on the frame 4 of the size press by means of a loading cylinder 5 which is linked with the application beam 11 by means of an articulated joint 6. The application beam 11 can be pivoted in relation to the articulation shaft 7 by means of the loading cylinder 5.

This type of construction of a size press described above is quite conventional and is in common use today. It is an advantage that the device in accordance with the present invention can be applied to this type construction in view of a modification of existing equipment.

The invention can also be applied to a coater in which the web W is passed over a back-up roll and the coating agent is metered directly onto the face of the web. Such an embodiment is not shown in the figures in the drawings, but it is readily understood from the following description referring to FIGS. 2 and 3 that the invention is also applicable to such a solution. This arrangement is described in the background of the invention and is also commonly used in prior art devices.

Figure 2:
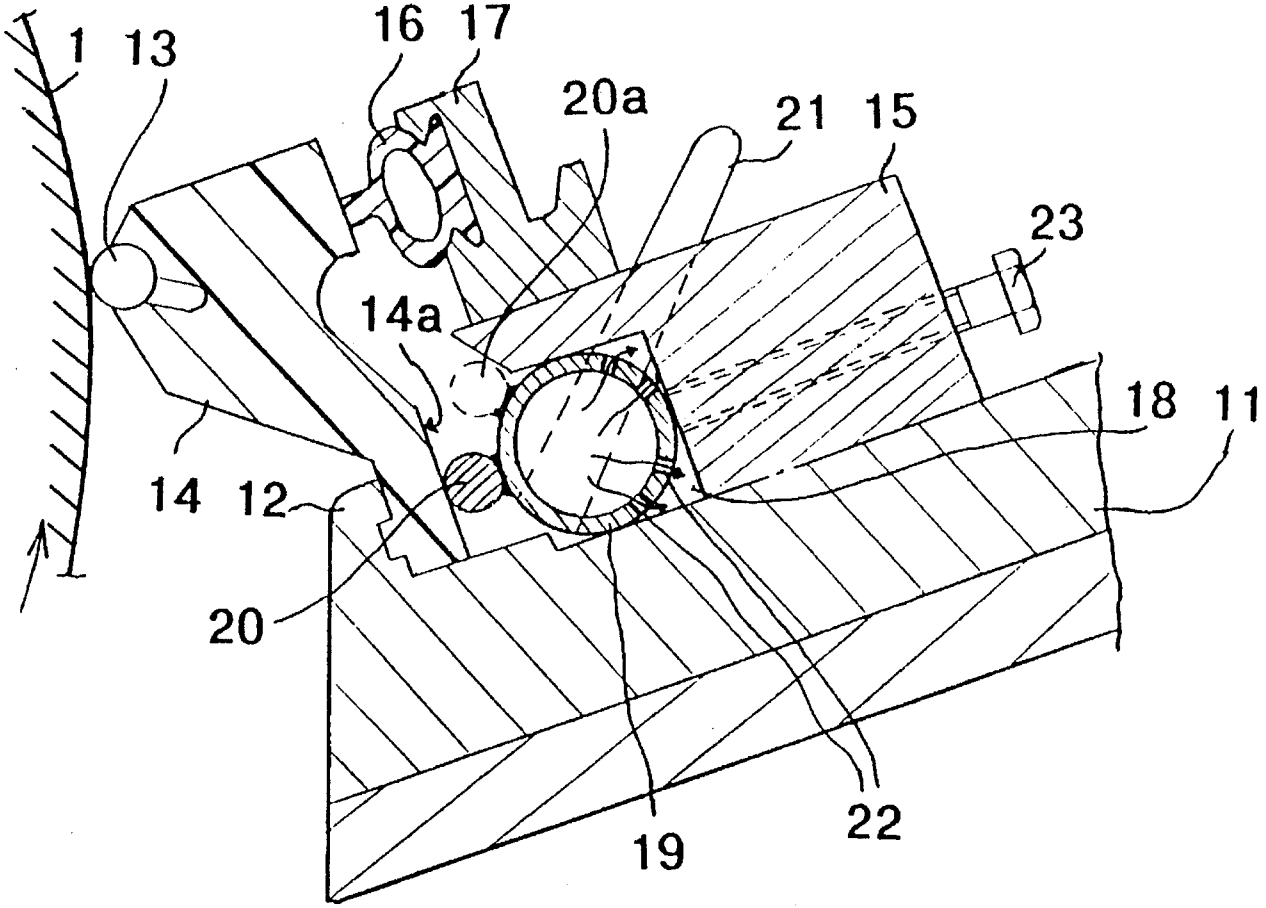
FIG. 2 is an enlarged detail of the illustration of FIG. 1, wherein, in an embodiment of a bar coater, the construction and the operation of a holder in accordance with the invention and used in a method in accordance with the invention are illustrated in more detail.

FIG. 2 is a more detailed illustration of an application of the present invention to a bar coater. In FIG. 2, reference numeral 1 denotes the moving base to be coated, which may be, for example, the face of a roll in a size press as shown in FIG. 1, or a web that runs along a back-up roll. In the embodiment shown in FIG. 2, the coating member comprises a coating bar 13 which is mounted revolvingly in the cradle 14 of the coating bar. In a manner known in the prior art, the material of the cradle 14 is, for example, polyurethane or equivalent. The coating bar 13 is loaded against the moving base 1 to be coated by means of a loading hose 16 acting upon the rear face of the cradle 14. By means of this loading, in a way known in prior art, the thickness of the layer of coating agent applied onto the base 1 to be coated is affected and regulated.

According to the embodiment shown in FIG. 2, the loading hose 16 is mounted in a profiled rib 17 which can be deflected in a desired way by means of adjusting spindles (not shown) so as to profile the layer of coating agent applied onto the base 1 to be coated. The cradle 14 of the bar 13 is mounted in a holder provided in the application beam 11. The holder of the present invention will be described in more detail below.

A frame 15 of the holder is attached to the application beam 11. The frame 15 is provided with a journalling duct 18 arranged transverse to the machine direction and is open toward the cradle 14 of the coating bar. An oblong member is arranged rotatably in the journalling duct 18 in a direction which is transverse to the machine direction. The oblong member comprises a pipe 19 and a rod 20, cam or equivalent, is arranged parallel to the pipe 19 and is fixed, e.g., by welding, to an outer face of the pipe 19. Further, the pipe 19 is provided with a turning device, at least at one end, such as a lever 21 shown in FIG. 2. By means of the lever 21, the pipe 19 can be rotated in the journalling duct 18.

After the cradle 14 of the coating bar has been mounted into its place in the holder in the way shown in FIG. 2, the front face of the cradle 14 rests against a support 12 which is arranged in the application beam 11. In the illustration in FIG. 2, the support 12 is shown as an integral part of the application beam, but it is preferable that the support 12 is fixed to the application beam 11 so that it can be detached.

When the cradle 14 is in its place, the pipe 19 has been turned by means of the turning device 21 into the position shown in FIG. 2. In this position, the rod 20 is pressed against a rear face 14*a* of the cradle and secures the cradle 14 in its operating place between the support 12 and the rod 20. When the cradle 14 is to be removed from the holder, the pipe 19 is rotated by means of the turning device 21 so that the rod 20 is shifted into a position 20*a* illustrated by the dashed line. Thus, the cradle 14 is not pressed between the rod 20 and the support 12 and can be easily removed.

Water is passed into the pipe 19 when necessary and is discharged out of the pipe 19 through holes 22 drilled into a wall of the pipe. The water that enters through these holes 22 into the journalling duct 18 lubricates the pipe 19 and prevents it from jamming in the journalling duct 18.

The adjustment of the degree of tightening of the fastening of the cradle 14, which can be achieved by means of the holder, can be accomplished, e.g., by means of the adjusting screws 23 shown in FIG. 2. A number of adjusting screws 23 are provided in the transverse direction of the machine, and by tightening the screws, the pipe 19 can be shifted closer to the cradle 14. In a corresponding way, when the screws are untightened, the pipe 19 is shifted apart from the cradle 14.

Figure 3:
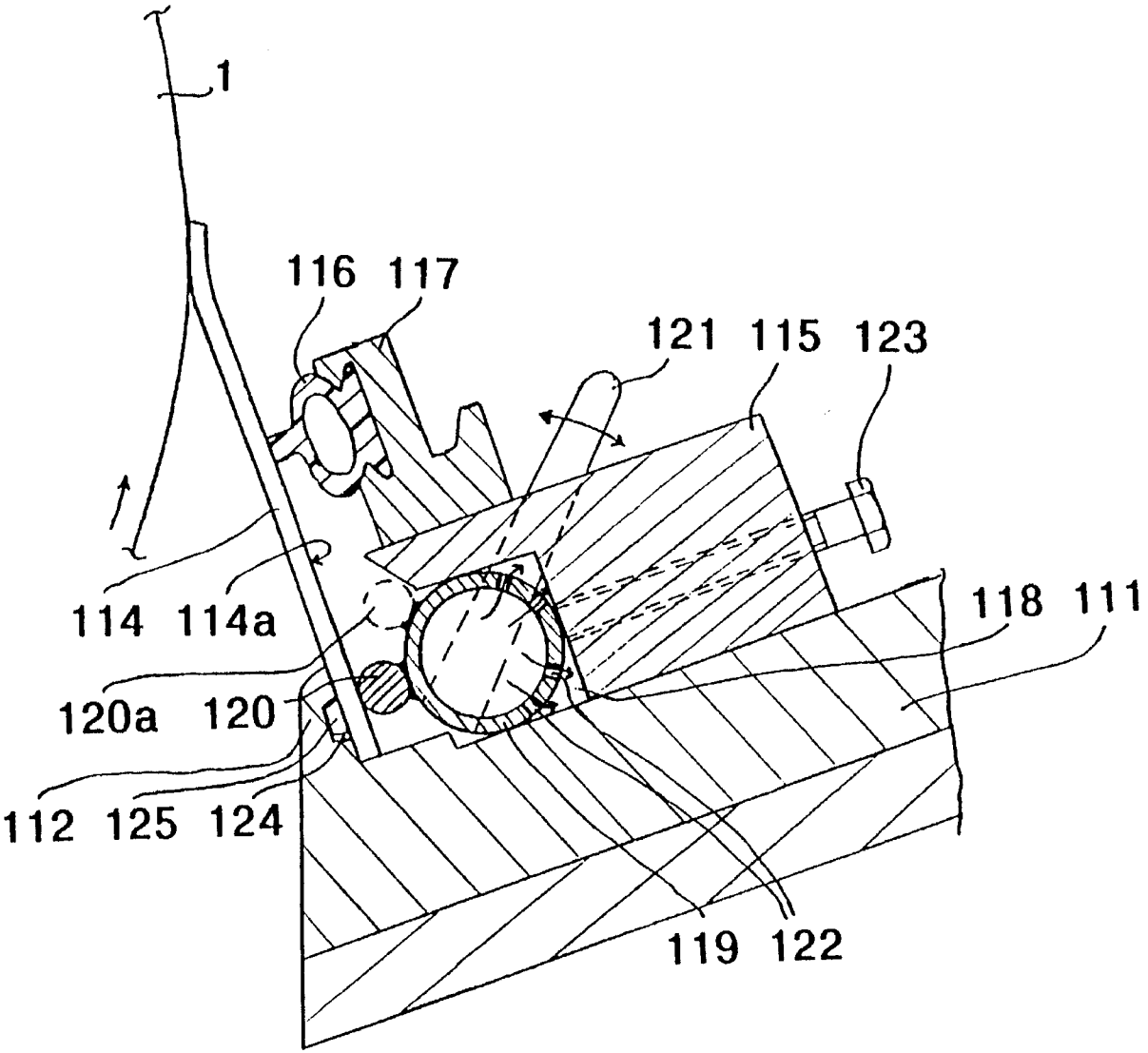
FIG. 3 is an illustration corresponding to FIG. 2 of an application of a holder in accordance with the invention to a blade coater which is used in a method in accordance with the invention.

In FIG. 3, an embodiment of the invention is shown in which the holder in accordance with the invention is arranged in connection with a blade coater. In FIG. 3, the moving base to be coated is also denoted with the reference numeral 1. A coating blade 114 is mounted in a holder arranged in an application beam 111. The coating blade 114 is loaded against the base 1 to be coated by means of a loading hose 116. In a manner corresponding to FIG. 2, the loading hose 116 is mounted in a profiled rib 117 which can be deflected in the desired way by means of adjusting spindles (not shown), i.e. by pulling and pushing, whereby the coating blade 114 can be profiled.

The holder of the coating blade 114 comprises a holder frame 115 attached to the application beam 111. A journalling duct 118 is formed in the frame 115 transverse to the machine direction and is open towards the coating blade 114. A pipe 119 is arranged rotatably in the journalling duct 118. Pipe 119 is provided with a rod 120 or equivalent, which is arranged parallel to the longitudinal direction of the pipe and is fixed to the outer face of the pipe by e.g., welding.

Further, the holder includes a support 112 which is fixed to the application beam 111 permanently or detachably. The coating blade 114 is supported against support 112 when it is mounted in its operating place. According to the illustration of FIG. 3, the coating blade 114 is secured in its position against the support 112 by rotating the pipe 119 so that the rod 120 or equivalent is supported against a rear face **114*a* of the coating blade. In order to make sure that the coating blade 114 remains in its position, a groove 124 is formed in support 122 and is arranged in a direction which is transverse to the machine direction. Groove 124 is open towards the coating blade 114. In a corresponding manner, a projection 125 is provided on the coating blade 114. Projection 125 is arranged to be transverse to the machine direction, is continuous or fragmentary, and penetrates into the groove 124 provided in the support 112**.

Pipe 119 is also provided with a turning device arranged at least at one end of the pipe, such as a lever 121 as shown in FIG. 3. The pipe 119 can be rotated in the journalling duct 118 by means of the lever 121.

When the coating blade 114 is mounted in its place, the pipe 119 has been pivoted by means of the lever 121 into the position shown in FIG. 3 so that the rod 120 secures the coating blade 114 against the support 112. When the coating blade 114 is to be removed from the holder, the pipe 119 is rotated by means of the turning device 121 so that the rod 120 is shifted to position **20*a* illustrated by the dashed line in FIG. 3**.

Water is passed into the pipe 119 when necessary and is arranged to be discharged out of the pipe 119 through holes 122 drilled into a wall of the pipe leading into the journalling duct 118. The circulation of water prevents seizing and jamming of the pipe 119.

It is also illustrated in the embodiment of FIG. 3 that, in the holder in accordance with the invention, it is possible to arrange the degree of tightening of the coating blade 114 adjustable, e.g., by means of a system of adjusting screws 123 corresponding to that shown in FIG. 2.

In connection with the embodiments of FIGS. 2 and 3, it was described that the securing of the cradle 14 of the bar or the coating blade 114 is arranged by means of a rotatable pipe 19, 119, respectively, arranged in the journalling duct 18, 118 and by means of a rod 20, 120 fixed to the pipe. This arrangement can, of course, be replaced, e.g., by means of a solution in which the pipe in itself has been shaped eccentric so that it comprises a cam which is supported against the rear face **14*a*, 114*a* of the cradle or the coating blade when the pipe is rotated. Thus, the pipe 119 and rod 120** may be formed from one piece of material in the desired eccentric shape.

In addition, a rotatable pipe can be substituted for by any such eccentric, oblong, and/or rotatable member arranged in the journalling duct 18, 118 provided that the rotation of the member permits securing of the bar cradle 14 or of the coating blade 114 in its position. In such an oblong member, it is also possible to arrange circulation of water, e.g., by means of various bores.

The examples provided above are not meant to be exclusive. Many other variations of the present invention would be obvious to those skilled in the art, and are contemplated to be within the scope of the appended claims.

We claim:

1. An assembly for use in a coating unit including means for containing and applying a size film or a corresponding layer of a coating agent onto a face of a moving base to be coated, said assembly comprising a coating blade or a cradle comprising a coating bar, said coating bar or said coating blade being loaded against the moving base to spread and smooth the size film or the corresponding layer of coating agent on the face of the moving base, a holder for retaining said cradle or said coating blade, said holder comprising an application beam arranged in a first direction, said application beam having a support arranged thereon, a frame arranged on said application beam, a journalling duct arranged in said frame in said first direction, and an oblong member rotatably arranged in said journalling duct and having a cam projection, said oblong member being rotatable to engage and fix said cradle of said coating bar or said coating blade in an operating position such that said projection rests against a rear face of said cradle of said coating bar or a rear face of said coating blade and secures said cradle or said coating blade against said support.

2. The assembly of claim 1, wherein said oblong member has a length in said first direction and further comprises a longitudinal bore or cavity that extends across its length.

3. The assembly of claim 2, wherein said oblong member further comprises transverse bores which extend into said longitudinal bore or into said cavity, said longitudinal bore or said cavity being arranged to circulate water therethrough so that the water is discharged out of said longitudinal bore or said cavity through said transverse bores and into said journalling duct for lubrication.

4. The assembly of claim 1, further comprising adjusting means arranged in said frame for displacing said oblong member in said journalling duct toward and away from said cradle or said coating blade such that the fixing tightness of said cradle or said coating blade is adjustable.

5. The assembly of claim 4, wherein said adjusting means comprise screws.

6. The assembly of claim 1, further comprising a turning device connected to at least one end of said oblong member.

7. The assembly of claim 1, wherein said oblong member comprises a pipe and an irregular cam or rod connected to said pipe to provide said projection.

8. The assembly of claim 7, wherein said cam is permanently fixed to an outer face of said pipe.

9. The assembly of claim 8, wherein said cam is fixed to said outer face of said pipe by welding.

10. The assembly of claim 1, wherein said oblong member comprises a circular pipe having an outer face and a rod fixed onto the outer face of said pipe by welding to thereby form said projection.

11. The assembly of claim 6, wherein said turning device comprises a lever attached to an end of said oblong member.

12. The assembly of claim 1 wherein said assembly comprises a coating blade, further comprising a groove formed on said support, said coating blade having a projection which penetrates into said groove.

* * * * *